US007701315B2

(12) United States Patent
Mecke et al.

(10) Patent No.: US 7,701,315 B2
(45) Date of Patent: Apr. 20, 2010

(54) INDUCTIVE ROTARY TRANSFER DEVICE

(75) Inventors: Rudolf Mecke, Magdeburg (DE); Christian Rathge, Irxleben (DE)

(73) Assignees: Siemens Aktiengesellschaft, Munich (DE); Institut fur Automation und Kommunikation e.V., Barleben (DE)

( * ) Notice: Subject to any disclaimer, the term of this patent is extended or adjusted under 35 U.S.C. 154(b) by 177 days.

(21) Appl. No.: 11/886,246

(22) PCT Filed: Mar. 23, 2006

(86) PCT No.: PCT/EP2006/060998

§ 371 (c)(1),
(2), (4) Date: Sep. 13, 2007

(87) PCT Pub. No.: WO2006/100294

PCT Pub. Date: Sep. 28, 2006

(65) Prior Publication Data

US 2008/0211614 A1 Sep. 4, 2008

(30) Foreign Application Priority Data

Mar. 24, 2005 (EP) ..... 05006641

(51) Int. Cl.
*H01F 21/06* (2006.01)
*H01F 21/04* (2006.01)
*H01F 27/02* (2006.01)

(52) U.S. Cl. ..... 336/130; 336/115; 336/118; 336/123; 336/131; 336/83

(58) Field of Classification Search ..... 336/115–120, 336/130–135
See application file for complete search history.

(56) References Cited

U.S. PATENT DOCUMENTS

| | | | | |
|---|---|---|---|---|
| 3,758,845 | A * | 9/1973 | MacKelvie et al. | 340/870.32 |
| 4,321,572 | A * | 3/1982 | Studer et al. | 336/83 |
| 4,404,559 | A * | 9/1983 | Renner | 340/870.28 |
| 4,425,511 | A * | 1/1984 | Brosh | 307/106 |
| 4,590,453 | A | 5/1986 | Weissman | |
| 5,347,256 | A | 9/1994 | Yumiki et al. | |
| 6,489,874 | B2 * | 12/2002 | Katsura et al. | 336/130 |
| 2001/0038280 | A1 * | 11/2001 | Aizawa et al. | 323/355 |

FOREIGN PATENT DOCUMENTS

| | | |
|---|---|---|
| DE | 199 14 395 A1 | 10/2000 |
| EP | 0 510 926 A2 | 10/1992 |
| JP | 2001/015361 A | 1/2001 |

* cited by examiner

*Primary Examiner*—Elvin G Enad
*Assistant Examiner*—Ronald W Hinson

(57) ABSTRACT

A device for contactless transfer of energy and data. One embodiment includes a primary coil assembly on a first support and a secondary coil assembly on a second support, the supports rotatable in relation to one another, the primary and secondary coil assemblies having an energy coil for inductive transfer of electric energy. To minimize interference in data transfer, the primary and secondary coil assemblies may include at least one data coil for inductive data transfer wherein at least one winding of the data coil surrounds at least one winding of the energy coil so that a first section of the data winding is wound in the wound direction of the energy coil and a second section of the data winding is wound in a direction opposite the wound direction of the energy coil.

18 Claims, 4 Drawing Sheets

INDUCTIVE ROTARY TRANSFER DEVICE

CROSS REFERENCE TO RELATED APPLICATIONS

This application is the US National Stage of International Application No. PCT/EP2006/060998, filed Mar. 23, 2006 and claims the benefit thereof. The International Application claims the benefits of European application No. 05006641.4 EP filed Mar. 24, 2005, both of the applications are incorporated by reference herein in their entirety.

FIELD OF INVENTION

The invention relates to a device for the contactless transfer of energy and data, said device comprising two supports which are rotatable in relation to one another, wherein primary and secondary windings of a transfer device are arranged on said supports.

BACKGROUND OF INVENTION

A device of said type is used, for example, for transferring energy and data between two components which move relative to each other. Such component arrangements are found in particular in robotic applications, in which rotation angles of 360 degrees and more are sometimes required between components of a robot, and data and energy must be transferred between said components. A further example of an application area for such a device is the transfer of energy and data between steering spindle and steering column of a motor vehicle.

In the case of a conductor-based transfer of energy and data, the cables which are used must have very significant flexibility in the region of the swivel joint in order to minimize wear and production stoppages. An inductive contactless transfer of energy and data between parts which can be rotated in relation to one another is therefore advantageous.

DE 199 14 395 A1 discloses an inductive transformer device for transferring measurement data and/or electrical energy between two components which can be moved relative to each other, in particular between the steering spindle and the steering column of a motor vehicle, using a primary and a secondary transfer part.

EP 0 510 926 A2 discloses a rotatable transformer for contactless signal transfer between a rotating part and a stationary part of the transformer. The transformer comprises various iron cores having various frequency characteristics. The iron cores are used in each case for frequency-selective transfer of the signals, whereby the efficiency of the data transfer is improved and the size of the transformer is reduced. Using the transformer, both data signals and signals for transferring electrical energy are transferred between the rotating part and the stationary part.

SUMMARY OF INVENTION

The invention addresses a problem of allowing an inductive contactless transfer of energy and data between two components which can be rotated in relation to each other, wherein interference of the data transfer as a result of the energy transfer is minimized.

This problem is solved by a device for the contactless transfer of energy and data, said device comprising a primary winding arrangement which is arranged in a fixed manner on a first support and a secondary winding arrangement which is arranged in a fixed manner on a second support, wherein the first and second supports are rotatable in relation to one another and the primary and secondary winding arrangements in each case have at least one energy winding for the inductive transfer of electrical energy, wherein primary and secondary winding arrangements in each case have at least one data winding for the inductive transfer of data, and at least one data turn of the data winding encloses at least one energy turn of the energy winding such that a first part of the data turn is wound in the winding direction of the energy winding and a second part of the data turn is wound counter to the winding direction of the energy winding.

The invention is based on the knowledge that, in the case of an arrangement of the data winding and energy winding on a shared support, interference of the data winding from the energy winding can be virtually eliminated if the turns of the data winding enclose the energy winding. However, the winding direction of the energy winding must be considered in the case of such an enclosure. If the first part of the data turn is wound in the winding direction of the energy winding, the second part of the data turn must be wound counter to the winding direction of the energy winding. In this way it is ensured that a voltage which is induced in the first part of the data winding by the energy winding is compensated by a second voltage component which is induced in the second part of the data winding by the energy winding.

Since a separate transfer device is used in each case for energy transfer and data transfer, the number of turns for the inductive data transfer can be selected independently of the number of turns for the energy transfer. Consequently, both energy transfer system and data transfer system can be optimized independently.

In order to achieve a maximal compensation effect, it is advantageous to arrange the data winding relative to the energy winding such that magnetic field strength components which are generated by the energy winding compensate each other within a surface area which is enclosed by the data turn, thereby resulting in virtually no magnetic flux within the surface area. The compensation effect can be explained in physical terms in that the voltage which is induced in a data turn is proportional to the time-relative leakage of the magnetic flux within the surface area which covers this data turn. If virtually no magnetic flux is now present within the surface area as a result of the intended compensation effect, no voltage can be induced within the data turn which covers the relevant surface area and hence no interference can be coupled in.

The above described minimization of the magnetic flux within the surface area which is covered by the data winding can be achieved in particular because the energy turn is arranged essentially midway between the first part of the data turn, this being wound in the winding direction of the energy winding, and the second part of the data turn, this being would counter to the winding direction of the energy winding. As a result of this, approximately half of the surface area which is enclosed by the data turn is influenced by a magnetic field strength which is opposite to the field strength which influences the other half of the enclosed surface area. The field strength components of the two halves of the surface area therefore compensate each other, resulting in virtually no magnetic flux in terms of the total surface area. Due to the minimized resulting magnetic flux it is also impossible to induce a voltage in the data turn and hence no interference can be coupled into the data turn from the energy turn.

A compact size of the device for contactless transfer of energy and data can be achieved by implementing the primary winding arrangement and the secondary winding arrangement as flat coils in each case.

In an advantageous embodiment of the invention, the first and second supports are implemented such that they are rotationally symmetrical, and are arranged such that they are axially offset in relation to each other, and have a shared axis of rotation. In such an embodiment, the first and second supports can be rotated relative to each other about the shared axis of rotation.

In particular when the primary winding arrangement and the secondary winding arrangement are implemented in the form of a flat coil, it is advantageous to implement the first and second supports as ferrite reflectors in order to minimize the stray flux. Ferrites are extremely suitable as core materials for inductive transfer devices, since they cause only slight eddy losses due to their low electrical conductivity, even in the case of high frequencies.

In a particularly advantageous application of the device for contactless transfer of energy and data, the device is provided for installation in systems featuring rotary motion, particularly in the context of automation engineering, wherein the first support is connected to a fixed part of the system and the second support is connected to a rotatable part of the system. A robot having a rotatable grasping arm can be cited as an example in this context. A rotation angle range of 0 to 360° or even more, in which the first support must be rotatable relative to the second support, is sometimes required in this type of configuration. In an application of the device in the field of robotics, for example, in which a transfer of energy and data must be implemented between components that can be rotated relative to each other, the device can be installed directly on a corresponding jointed shaft. In the case of such an embodiment it is effective for the first and second supports to be implemented in an annular manner. By virtue of the annular implementation, the jointed shaft can be passed directly through the first and second supports and hence through the device.

In particular when the device for contactless transfer of energy and data must be upgraded in an existing arrangement of components which can be rotated in relation to one another, it is expedient if the first and second supports can be divided in each case into a first and second part-support, wherein the first and second part-supports have in particular a semicircular opening in each case. As a result of the divisibility of the device, the transfer device comprising the first and second supports and the associated primary and secondary winding arrangements can be installed on a jointed shaft without having to separate said jointed shaft for this purpose. Consequently, the expense in terms of installation and cost is significantly reduced. As a result of the semicircular openings, the part-supports can be fixed around a jointed shaft very easily.

In the case of such a divisible transfer device, it is particularly advantageous if the energy winding and the data winding in each case have a first and a second coil, these being serially connected in particular, wherein the first coil is arranged on the first part-support and the second coil is arranged on the second part-support. In the case of such a winding arrangement it is particularly advantageous that, even if there is a large number of turns in the first and second coils, only one cable connection is required between the two coils and hence between the two part-supports for the energy winding, and one for the data winding.

In the case of rotationally symmetrical annular transfer apparatuses in particular, the divisibility of the energy and data transfer can be achieved by closing at least one first turn of the first coil within the first part-support and at least one second turn of the second coil within the second part-support, such that said turns have in each case an inner turn section having an inner radius and an outer turn section having an outer radius which is greater than the inner radius. As a result of this, the number of turns of the coils of a part-support is freely selectable and an optimal transfer functionality can be set (separately for the energy transfer and data transfer). For the connection of the coils on the part-supports, only one cable connection is required in each case for the energy winding and the data winding.

BRIEF DESCRIPTION OF THE DRAWINGS

The invention is described and explained in greater detail below with reference to the exemplary embodiments illustrated in the figures, in which.

DETAILED DESCRIPTION OF INVENTION

Figure 1:
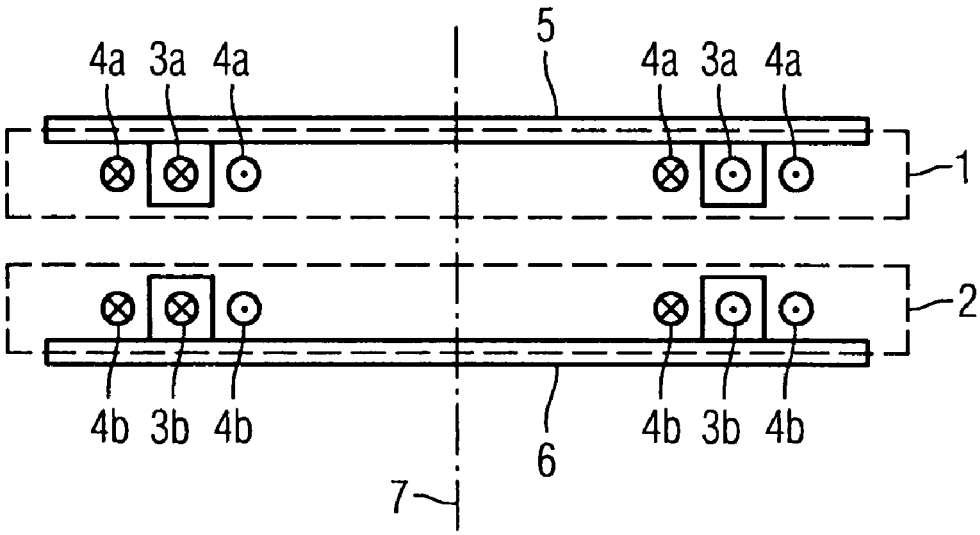
FIG. 1 shows a sectional view of a first flat coil arrangement for contactless transfer of energy and data.

FIG. 1 shows a sectional view of a first coil arrangement for contactless transfer of energy and data, comprising a first support 5 on which a primary winding arrangement is arranged in a fixed manner and a second support 6 on which a secondary winding arrangement 2 is arranged in a fixed manner. The illustrated flat coil arrangement is used, for example, for the inductive transfer of energy and data in the case of a robot having a rotatable joint. In this type of configuration, for example, the first support 5 is connected to a fixed part of the robot and the second support 6 is connected to a part of the robot which is mounted rotatably in relation to the first part of the robot. In such an application, the first and second supports 5,6 are implemented in an annular manner and attached to the swivel-joint shaft of the robot. The primary winding arrangement 1 has a primary-side energy winding 3*a*, this being supplied for example by a power converter and generating a field which couples into a secondary-side energy winding 3*b*, this being an integral part of the secondary winding arrangement 2. In this way it is possible to transfer energy via the swivel joint of the robot without the need for a cable connection which is susceptible to wear.

In addition to the energy transfer, the illustrated flat coil arrangement also provides a contactless inductive data transfer between the rotatably mounted parts of the robot. In order to achieve this, primary winding arrangement 1 has a primary-side data winding 4*a* and secondary winding arrangement has a secondary-side data winding 4*b*, wherein a magnetic field which is generated by the primary-side data winding 4*a* couples into the secondary-side data winding 4*b*.

The first and second supports 5,6 and the primary winding arrangement 1 and the secondary winding arrangement 2 are implemented such that they are rotationally symmetrical, are axially offset, and have a shared axis of rotation 7. An implementation of this kind is advantageous in particular for installation on a swivel-joint shaft. Furthermore, the first and second supports 5,6 are implemented in an annular manner, and have an opening in the region of the axis of rotation 7. The opening allows the swivel-joint shaft of the robot to pass through.

The winding arrangements show that a conductor of the primary-side energy winding 3*a* is surrounded on both sides by a conductor of the primary-side data winding 4*a*. This, like the following observation, applies similarly to the secondary side, since the fundamental construction of primary and secondary winding arrangement 1,2 is the same.

Each conductor of the primary-side energy winding 3*a* is arranged essential midway between the two conductors of the primary-side data winding 4*a*. In particular it should be noted in this context that the winding direction of the primary-side data winding 4*a* on one side of the conductor of the primary-side energy winding 3*a* runs counter to the winding direction of the primary-side data winding 4*a* on the other side of the primary-side energy winding 3*a*. In the case of a primary-side energy and data winding 3*a*,4*a* through which a current flows, this means that adjacent to a conductor of the primary-side energy winding 3*a* on its left-hand side is a conductor of the primary-side data winding 4*a* whose current flows in the same direction as that of the energy conductor, wherein the current direction within the data conductor on the other side of the energy conductor is opposite to the current direction of the energy conductor. As a result of this, voltages having opposing directions are induced in the data conductors to the right and left of the energy conductor and offset each other within a data winding. This winding arrangement is illustrated again with reference to FIG. 2.

Figure 2:
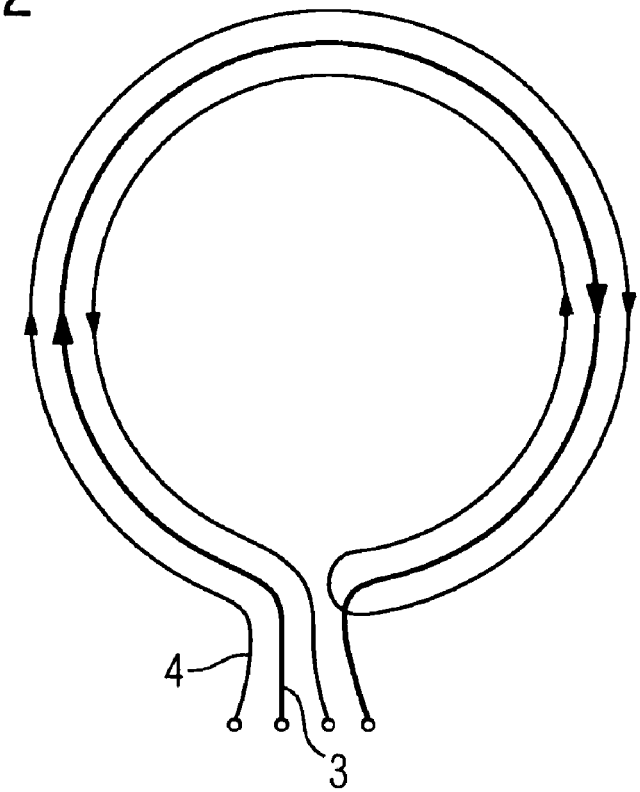
FIG. 2 shows a plan view of the first flat coil arrangement for contactless transfer of energy and data.

FIG. 2 shows a plan view of the first coil arrangement for contactless transfer of energy and data. Because there is generally no difference between the winding layout of the primary and secondary winding arrangements, only one side of the transfer apparatus is illustrated here and can depict both the primary-side winding arrangement and the secondary-side winding arrangement. FIG. 2 shows that a turn of the energy winding 3 is enclosed on both sides by a conductor of a data turn of the data winding 4. In the case of a data turn through which a current flows, the current directions are opposite in each case within the data conductors which are adjacent to the energy turn. This type of winding provides a compensation effect of the induced voltages within the data turn, said compensation effect being illustrated in FIG. 3.

Figure 3:
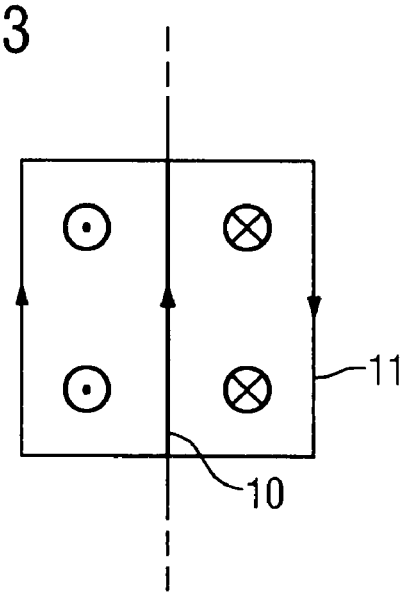
FIG. 3 shows an energy conductor piece and an integration path for an induced electrical field strength.

FIG. 3 shows an energy conductor piece 10 and an integration path 11 for an induced electrical field strength. The integration path 11 covers a rectangular surface area in which the energy conductor piece 10 forms a symmetrical axis.

A current direction for the energy conductor piece 10 is characterized by an arrow. Such a current direction generates a magnetic field strength which extends into the projection plane to the right of the energy conductor piece 10 and out of the projection plane to the left of the energy conductor piece 10. Within the surface area which is covered by the integration path 11, the field strength components to the right of the energy conductor piece 10 compensate those to the left of the energy conductor piece 10, thereby resulting in no magnetic flux within the surface area which is covered by the integration path 11. It follows that the induced voltage within a conductor loop which is characterized by the integration path 11 is exactly zero. Moreover, the arrangement of the integration path 11 in relation to the energy conductor piece 10 characterizes precisely the arrangement of the data winding in relation to the energy winding in the embodiments of the device according to the invention as illustrated in FIG. 1 and FIG. 2. This shows that, in the case of the winding arrangements which are illustrated in FIGS. 1 and 2, no voltage is induced in the data winding from the energy winding. Consequently, no interference from the energy winding is expected within the data winding.

In the winding arrangements comprising a flat coil arrangement as shown in FIGS. 1 and 2, the number of turns was assumed to be one in each case for both the energy winding and the data winding. Of course, other embodiments of the energy winding and the data winding are also possible and are covered by the invention.

Figure 4:
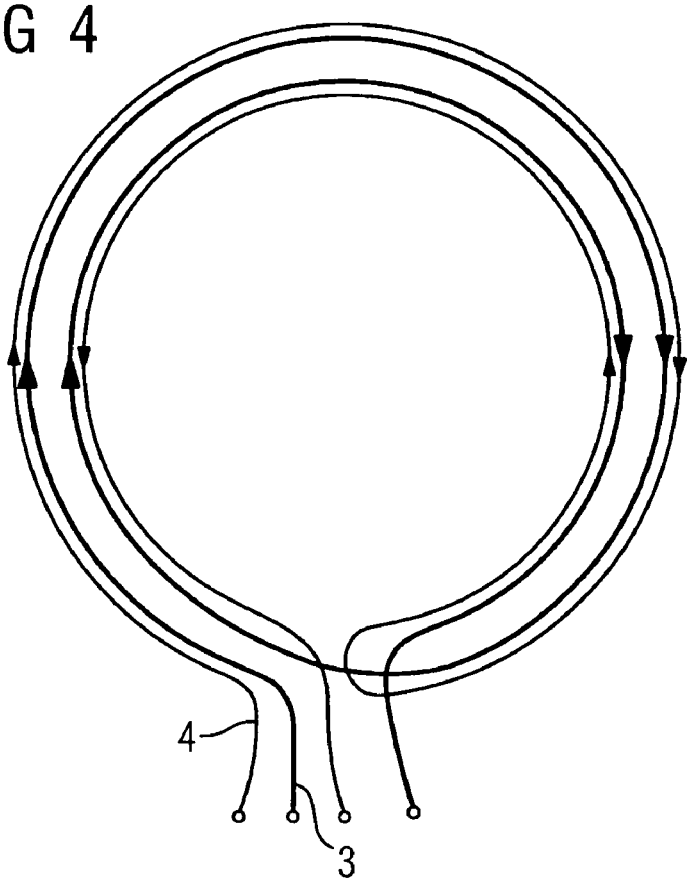
FIG. 4 shows a second flat coil arrangement with two energy turns.

FIG. 4 shows a second flat coil arrangement with two energy turns of an energy winding 3. In this case a data winding 4 is wound in relation to the energy winding 3 in such a way that one conductor of a data turn of the data winding 4 is arranged in the winding direction of the energy winding 3 and one conductor of the data turn is arranged counter to the winding direction of the energy winding 3. In this way two turns of the energy winding 3 in each case are located between two conductors of the data turn. The desired compensation effect of the magnetic field strength within the data winding 4 is achieved again in the embodiment which is illustrated here.

Figure 5:
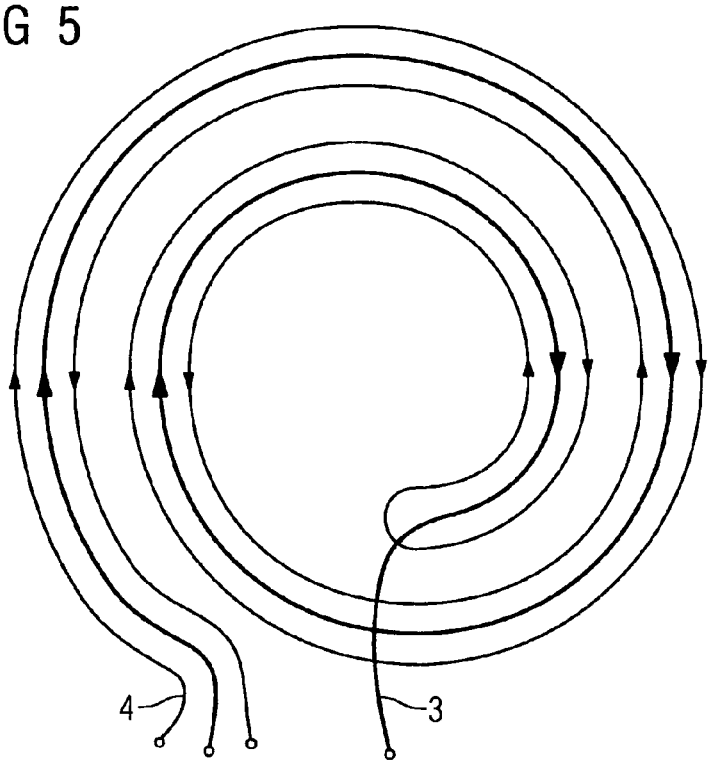
FIG. 5 shows a third flat coil arrangement with two energy turns.

FIG. 5 shows a third flat coil arrangement with two energy turns of an energy winding 3. The number of turns of a data winding 4 is also one in this case, as in the arrangement seen in FIG. 4. In this case, however, the data winding 4 is wound such that only one energy turn of the energy winding 3 is arranged in each case between an outward conductor and a return conductor of a data turn of the data winding 4. The desired compensation effect of the induced electrical field strength which is caused by the magnetic field strength generated by the energy winding 3 is achieved again in this case. However, because the partial magnetic fields which are caused by the energy conductors suppress each other in a horizontal direction in the case of such a closely adjacent arrangement of energy conductors having opposite current directions, the extension of the magnetic field in a vertical direction (across the air gap) is relatively small. This means that the magnetic coupling between primary and secondary side is reduced for the energy transfer.

Figure 6:
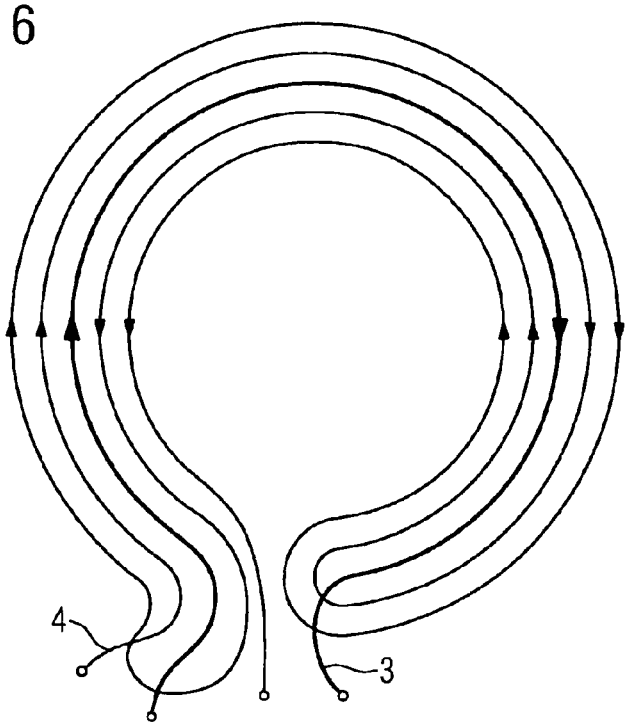
FIG. 6 shows a fourth flat coil arrangement with two data turns.

Obviously it is also possible to implement the data winding 4 with two turns. FIG. 6 shows a fourth flat coil arrangement with two data turns of a data winding 4. In the case illustrated here, the number of turns of an energy winding 3 is one. In this context, the illustrated turn of the energy winding 3 is enclosed on both sides by two conductors of the data winding 4. Once again, the field strength components which are induced by the energy winding 3 compensate each other within the data turns of the data winding 4. It is consequently possible largely to exclude interference of the data winding 4 from the energy winding 3 in this case also.

Figure 7:
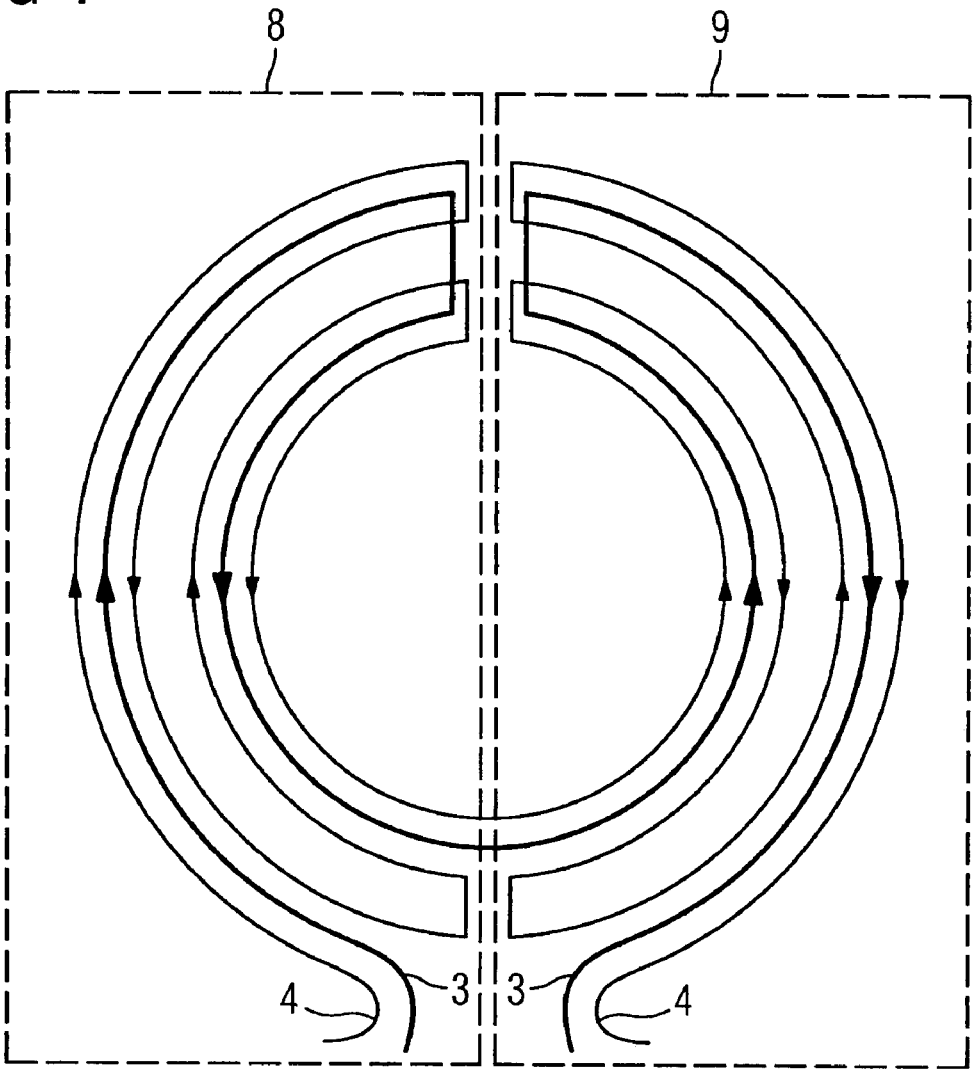
FIG. 7 shows a divisible flat coil arrangement.

FIG. 7 shows a divisible flat coil arrangement which is provided for inductive contactless transfer of energy and data. Such a flat coil arrangement is arranged on a divisible annular support, for example. By means of such a support, the illustrated flat coil arrangement can be installed on a swivel-joint shaft, in particular of a robot, very easily. As a result of the divisibility of the flat coil arrangement, the transfer apparatus can be attached directly to the jointed shaft without having to disassemble said jointed shaft beforehand. The illustrated flat coil arrangement has a first coil arrangement 8 consisting of an energy winding 3 and a data winding 4, and a second coil arrangement 9 which likewise has an energy winding 3 and a data winding 4. The first and second coil arrangements 8,9 are connected together by only one cable connection for the energy winding 3 and one cable connection for the energy winding 3. Even in the case of a much higher number of windings for the first and second coil arrangements 8,9, only one connection would be required in each case for the energy and data windings 3,4. The divisible flat coil arrangement is characterized in that the first coil arrangement 8 is connected in series with the second coil arrangement 9, wherein the coil arrangements 8,9 are again wound in such a way that at least one data turn of the data winding 4 encloses at least one energy turn of the energy winding 3 such that a first part of the data turn is wound in the winding direction of the energy winding 3 and a second part of the data turn is wound counter to the winding direction of the energy winding 3.

All of the flat coil arrangements illustrated in the figures have the advantage that separate windings are provided for the energy winding 3 and the data winding 4. Consequently, the energy winding 3 can be optimized for an optimal inductive transfer of energy between the primary winding arrangement and the secondary winding arrangement, and the data winding 4 can be optimized for an optimal inductive transfer of data between the first and second supports or between the primary winding arrangement and the secondary winding arrangement. Furthermore, as a result of the inventive arrangement of the data winding 4 in relation to the energy winding 3, the magnetic field of the energy winding 3 induces virtually no voltage within the data turns of the data winding 4 and therefore has no interference effect on the data transfer.

The invention claimed is:

1. A device for a contactless transfer of energy and data, comprising:

a primary winding arrangement arranged on a first support, wherein the primary winding arrangement has at least one energy winding for an inductive transfer of electrical energy, and wherein the primary winding arrangement has at least one data winding for an inductive transfer of data;

a secondary winding arrangement arranged on a second support, wherein the first support and the second support are rotatable in relation to one another, wherein the secondary winding arrangement has at least one energy winding for the inductive transfer of electrical energy, and wherein the secondary winding arrangement has at least one data winding for the inductive transfer of data; and at least one data turn of the data winding to enclose at least one energy turn of the energy winding such that a first part of the data turn is wound in a winding direction of the energy winding and a second part of the data turn is wound counter to the winding direction of the energy winding, wherein the data winding is arranged relative to the energy winding such that magnetic field strength components generated by the energy winding compensate each other within a surface area which is enclosed by the data turn.

2. The device as claimed in claim 1, wherein the compensation results in virtually no magnetic flux within the surface area.

3. The device as claimed in claim 1, wherein the energy turn is arranged essentially midway between the first part of the data turn, and the second part of the data turn.

4. The device as claimed in claim 1, wherein the primary winding arrangement is based on flat coils, and wherein the secondary winding arrangements are based on flat coils.

5. The device as claimed in claim 3, wherein the primary winding arrangement is based on flat coils, and wherein the secondary winding arrangements are based on flat coils.

6. The device as claimed in claim 1, wherein the first support and the second support are rotationally symmetrical, wherein the first support and the second support share an axis of rotation, and wherein the first support and the second support are arranged on the shared axis with an axial offset in relation to each other.

7. The device as claimed in claim 5, wherein the first support and the second support are rotationally symmetrical, wherein the first support and the second support share an axis of rotation, and wherein the first support and the second support are arranged on the shared axis with an axial offset in relation to each other.

8. The device as claimed in claim 1, wherein the first support and the second support are ferrite reflectors.

9. The device as claimed claim 1, wherein the device is installed in an automation system featuring a rotary motion, wherein the first support is connected to a fixed part of the automation system and the second support is connected to a rotatable part of the automation system.

10. The device as claimed in claim 7, wherein the first support is connected to a fixed part of the automation system, and wherein the second support is connected to a rotatable part of the automation system.

11. The device as claimed in claim 9, wherein the first support is annular, and wherein the second support is annular.

12. The device as claimed in claim 10, wherein the first support is annular, and wherein the second support is annular.

13. The device as claimed in claim 1, wherein the first support and second support are divided in each case into a first part-support and a second part-support.

14. The device as claimed in claim 13, wherein the first part-support has a semicircular opening and the second part-support has a semicircular opening.

15. The device as claimed in claim 1, wherein the energy winding has a first coil and a second coil, wherein the data winding has a first coil and a second coil, wherein the first coil is arranged on the first part-support, and wherein the second coil is arranged on the second part-support.

16. The device as claimed in claim 15, wherein the first coil of the energy winding and the second coil of the energy winding are connected in serial, and wherein the first coil of the data winding and the second coil of the data winding are connected in serial.

17. The device as claimed in claims 13, wherein at least one turn of the first coil is closed within the first part-support, and wherein at least one turn of the second coil is closed within the second part-support, such that the turns have in each case an inner turn section having an inner radius and an outer turn section having an outer radius, wherein the outer radius is greater than the inner radius.

18. The device as claimed in claims 16, wherein at least one turn of the first coil is closed within the first part-support, and wherein at least one turn of the second coil is closed within the second part-support, such that the turns have in each case an inner turn section having an inner radius and an outer turn section having an outer radius, wherein the outer radius is greater than the inner radius.

* * * * *